United States Patent [19]

Murayama et al.

[11] Patent Number: 4,497,303

[45] Date of Patent: Feb. 5, 1985

[54] FUEL INJECTION TIMING DEVICE FOR INTERNAL COMBUSTION ENGINES

[75] Inventors: Fumiaki Murayama; Shizuo Handa, both of Kariya, Japan

[73] Assignee: Nippondenso Co., Ltd., Kariya, Japan

[21] Appl. No.: 448,438

[22] Filed: Dec. 10, 1982

[30] Foreign Application Priority Data

Dec. 11, 1981 [JP] Japan ..... 56-199758

[51] Int. Cl.[3] ..... F02M 59/20

[52] U.S. Cl. ..... 123/501; 123/502; 464/2; 464/3

[58] Field of Search ..... 123/501, 502; 464/2, 464/3

[56] References Cited

U.S. PATENT DOCUMENTS

| | | | |
|---|---|---|---|
| 3,791,171 | 2/1974 | Hofmann | 123/501 |
| 3,951,118 | 4/1976 | Henson | 123/501 |
| 4,132,202 | 1/1979 | Nakayama et al. | 123/501 |
| 4,294,218 | 10/1981 | King et al. | 123/501 |
| 4,332,227 | 6/1982 | Bauer et al. | 123/502 |
| 4,354,473 | 10/1982 | Geyer et al. | 123/501 |

FOREIGN PATENT DOCUMENTS

| | | | |
|---|---|---|---|
| 240933 | 10/1962 | Australia | 123/501 |

*Primary Examiner*—Magdalen Y. C. Moy

*Attorney, Agent, or Firm*—Cushman, Darby & Cushman

[57] ABSTRACT

A fuel injection timing device for an internal combustion engine comprises a cam shaft connected to a fuel injection pump, a driven section coupled to the cam shaft and having a driven flange, a driving flange adjacent to the driven flange and coaxial with the cam shaft, a driven gear fixed to the driving flange so as to be coaxial with the cam shaft and in mesh with a driving gear driven by the internal combustion engine in a cylinder block facing the fuel injection pump, and a cam shaft phase angle changing mechanism for advancing and delaying the cam shaft in phase angle in cooperation with the driving flange and the driven flange. The timing device has a casing which contains the driven section, the driving flange, and the cam shaft phase angle changing mechanism. One end of the casing is supported by the fuel injection pump, and the other end supports the driving flange.

11 Claims, 5 Drawing Figures

FIG. 1
(PRIOR ART)
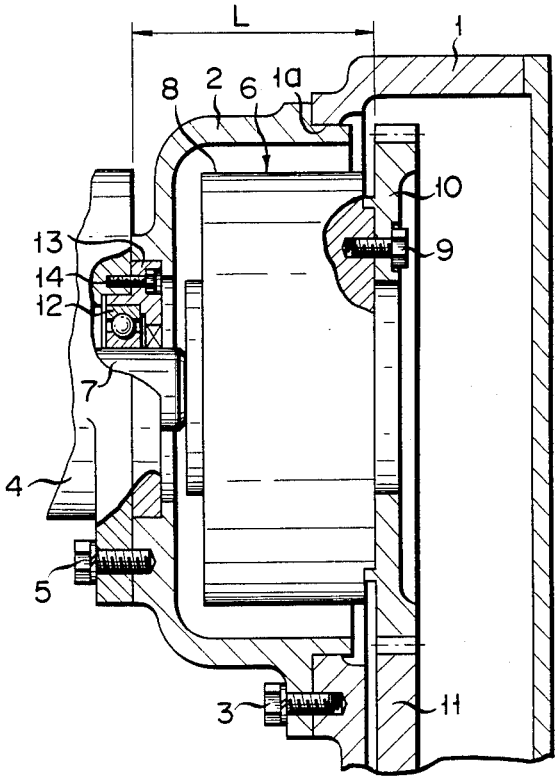
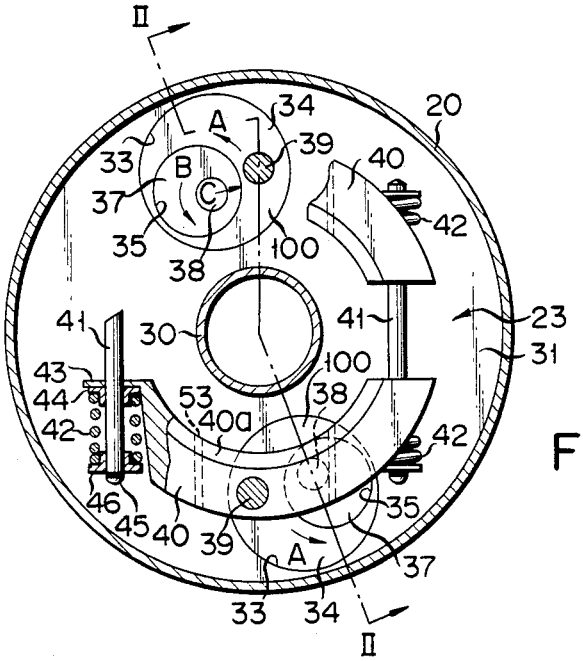
FIG. 3

FUEL INJECTION TIMING DEVICE FOR INTERNAL COMBUSTION ENGINES

BACKGROUND OF THE INVENTION

This invention relates to a fuel injection timing device for adjusting the injection timing for fuel supplied from a fuel injection pump according to the operating conditions of an internal combustion engine.

In an engine of a fuel injection type, fuel is delivered from a fuel injection pump which is driven by the power of the engine, and the injection timing needs to be advanced or delayed according to the operation conditions of the engine, such as change of engine speed. Accordingly, a timer unit is interposed between the engine and the fuel injection pump so that the timing of the engine rotation is advanced or delayed by the timer unit, and is transmitted to a pump driving shaft, for example, a cam shaft of the pump.

FIG. 1 shows an arrangement of a conventional fuel injection timing device in which the fuel injection pump is located outside a cylinder block on the engine side and the timer unit is located between the pump and the cylinder block. In FIG. 1, a gear case 2 is coupled to a cylinder block 1 on the engine side by means of bolts 3. A fuel injection pump 4 is fixed to the gear case 2 by bolts 5. A timer unit 6 is housed in the gear case 2. The timer unit 6, which may be of any conventional type, e.g., of a hydraulically-operated or centrifugal-weight type, advances the timing of the rotation of the engine according to the operating conditions, and transmits the adjusted rotation to a cam shaft 7 used as a pump shaft. The timer unit 6 has a casing 8 and a driven gear 10 coupled to one end of the casing 8 by means of bolts 9. The driven gear 10 is in mesh with a driving gear 11 which is driven by the crank shaft of the engine. The cam shaft 7 is supported on a bearing cover 13 by a bearing 12, and the bearing cover 13 is attached to the pump 4 by means of bolts 14. The bearing cover 13 is fitted in one end of the gear case 2, the other end of which is fitted in an opening 1*a* of the cylinder block 1.

In the prior art construction as shown in FIG. 1, however, engagement between the driven gear 10 and the driving gear 11 is attained by centering between the cam shaft 7 and the opening 1*a* of the cylinder block 1 by successively mating the bearing cover 13, the gear case 2, and the opening 1*a* of the cylinder block 1 with one another. In this case, some fit tolerances need to be set to facilitate the assembly of the mating parts. These fit tolerances or erros, when added up, prevent accurate centering. As a result, the timer characteristic (engine speed-injection timing characteristic) of the timer unit is subject to hysteresis, so that the engine characteristics in case when the engine speed increases and decreases will vary differ from each other.

The gear case 2 is provided outside the casing 8 of the timer unit 6 to form a dual covering structure. Thus, both axial and diametrical dimensions of the timer unit 6 are substantially large, so that the timer unit 6 cannot be used if the space between the pump 4 and the cylinder block 1 is small.

Moreover, the dual structure requires a great distance L between the driven gear 10 and the pump housing 1. Therefore, a great bending moment will probably be applied to the cam shaft 7 to damage the same during the drive.

SUMMARY OF THE INVENTION

The object of this invention is to provide a fuel injection timing device for an internal combustion engine which is capable of high-accuracy centering between a fuel injection pump and the engine, and operates under a stable timer characteristic, and whose number of parts is reduced for miniaturization.

According to this invention, there is provided a fuel injection timing device for an internal combustion engine, which comprises a cam shaft connected to a fuel injection pump, a driven section coupled to the cam shaft and having a driven flange, a driving flange adjacent to the driven flange and coaxial with the cam shaft, a driven gear fixed to the driving flange so as to be coaxial with the cam shaft and in mesh with a driving gear driven by the internal combustion engine in a cylinder block facing the fuel injection pump, cam shaft phase angle changing means for advancing and delaying the cam shaft in phase angle in cooperation with the driving flange and the driven flange, and a casing containing the driven section, the driving flange, and the cam shaft phase angle changing means and having two ends, one of which is supported by the fuel injection pump and the other of which supports the driving flange and is supported by the cylinder block.

BRIEF DESCRIPTION OF THE DRAWINGS

This invention can be fully understood from the following description with reference to the accompanying drawings, in which:

FIG. 1 is a vertical sectional view of a prior art fuel injection timing device;

FIG. 3 is a sectional view taken along line III—III of FIG. 2;

DETAILED DESCRIPTION OF THE PREFERRED EMBODIMENTS

Figure 2:
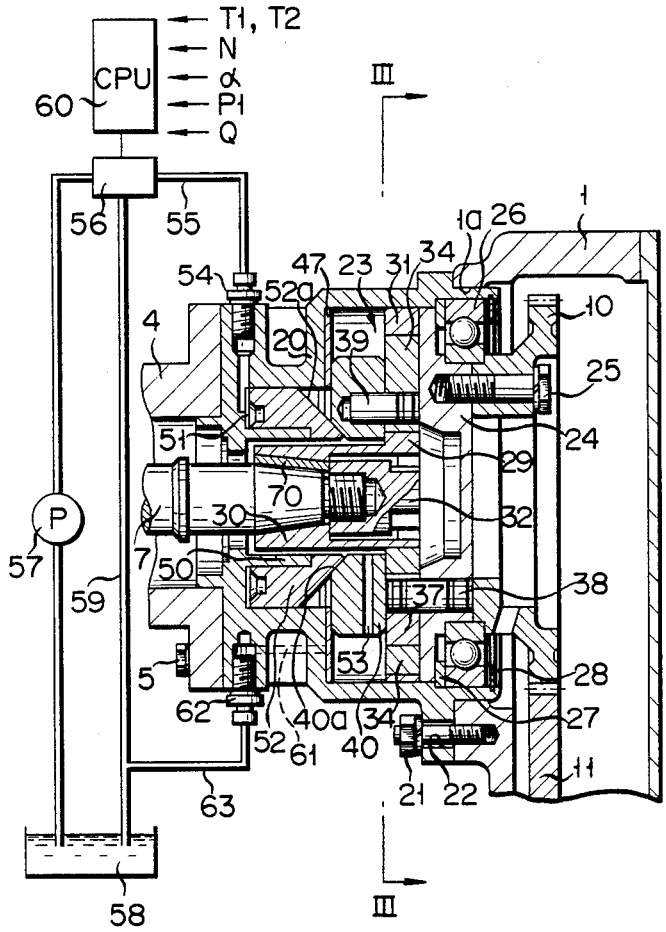
FIG. 2 is a vertical sectional view of a fuel injection timing device according to one embodiment of this invention.

In FIGS. 2 and 3, a cylinder block 1, a fuel injection pump housing 4, and a cam shaft 7 are similar to their counterparts shown in FIG. 1.

Figure 4:
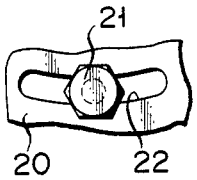
FIG. 4 is a front view of a fitting hole shown in FIG. 2.

A casing 20 has its one end fitted in an opening 1*a* of the cylinder block 1 and coupled to the cylinder block 1 by means of a bolt 21. The other end of the casing 20 is fixed to the pump housing 4 by means of bolts 5. In fixing the casing 20 to the cylinder block 1 by means of the bolt 21, the bolt 21 is passed through a fitting hole 22. As shown in FIG. 4, the fitting hole 22 is an arcuate slot extending along the circumferential direction of the cylinder block 1. Thus, the casing 20 is coupled to the cylinder block 1 so as to be rockable within a range corresponding to the length of the fitting hole 22.

The casing 20 contains a timer unit 23 which constitutes cam shaft phase angle change means. A driving flange 24 is connected to a driven gear 10 by means of bolts 25 at the cylinder block side end of the timer unit 23. A ball bearing 26 is fitted on the outer peripheral surfaces of the abutting regions of the driving flange 24 and the driven gear 10. The outer peripheral surface of the ball bearing 26 is pressed on the inner peripheral surface of one end portion of the casing 20. The ball bearing 26 is set in position on the driving flange 24 and the driven gear 10 by a spacer 27, and is prevented by a snap ring 28 from slipping out of the timer unit 23.

A driven section 29 at the central portion of the timer unit 23 is formed of a hub 30 and a driven flange 31 integrally formed at the cylinder block side end portion of the hub 30. The hub 30 is fixed to the cam shaft 7 by a key 70 and a round nut 32 which is screwed on a threaded portion of the cam shaft 7 on the cylinder block side. The driven flange 31 is in sliding contact with the driving flanges 24 on their opposed end faces, and is fitted in the casing 20 so that its outer peripheral surface may slide on the inner peripheral surface of the casing 20. The driven flange 31 is provided with a pair of dual eccentric cam mechanism 100. Referring now to FIG. 3, the dual eccentric cam mechanism 100 will be described in detail. The driven flange 31 has a pair of circular holes 33 in diametrically opposite positions. A larger eccentric cam 34 is diposed in each of the circular holes 33. An eccentric hole 35 is formed in the larger eccentric cam 34, and a smaller eccentrical cam 37 is rotatably fitted in the eccentric hole 35. A pin 38 protrudes from a portion of the smaller eccentric cam 37 off its center, and is rotatably fitted in the driving flange 24 (FIG. 2). An eccentric pin 39 protrudes from a portion of the larger eccentric cam 34 off its center, and is rotatably passed through the respective one of a pair of sliders 40 which are oppositely arranged in a cylindrical space surrounded by the driven flange 31 and the casing 20 so as to be coaxial with the casing 20 (FIGS. 2 and 3). The sliders 40 are radially moved by a pair of parallel guide shafts 41 passing the opposed ends of the sliders 40, and are urged toward each other by return springs 42. Each return spring 42 has its one end supported by a spring mounting portion 43 at one end portion of the slider 40 with a seat 44 interposed therebetween. The other end of the return spring 42 is supported by another seat 46 which is fitted on the end portion of the guide shaft 41 by means of a circle clip 45. A slide contact plate 47 is interposed between the opposed faces of the sliders 40 and the casing 20 so that the sliders 40 do not directly contact with the casing 20 while rotating (FIG. 2).

Referring to FIG. 2, a sleeve portion 50 surrounding the outer periphery of the hub 30 is integrally formed on the casing 20 at its driven side end portion. An annular pressure chamber 51 is formed around the sleeve portion 50 in the casing 20. An axially slidable cylindrical piston 52 surrounds the hub 30 in the pressure chamber 51. A truncated conical surface **52*a* is formed at the cylinder block side end portion of the piston 52. The face 52*a* is in slide contact, with reversely truncated conical surfaces 40*a* of the sliders 40 complementary thereto. Thus, when the piston 52 is moved to the right of FIG. 2, the sliders 40 are moved outward. Each slider 40 is provided with at least one radially penetrating oil escape hole 53 for the smooth movement of the slider 40**.

An oil inlet port 54 on the casing side is connected to the fuel injection pump housing side end of the pressure chamber 51. The port 54 communicates with a pressure control valve 56 through an oil passage 55. The pressure control valve 56 is connected to an oil tank 58 through an engine pump 57 and also through a by-pass line 59. The pressure control valve 56 is opened and closed by an electronic control device 60 such as a microcomputer (CPU). The electronic control device 60 operates the pressure control valve 56 to control the oil pressure in the pressure chamber 51. Signals from various sensors are sent to the electronic control device 60. These signals include signals for the engine exhaust gas temperature T1, engine speed N, advance or delay angle $\alpha$ of the pump driving shaft, ambient temperature T2, ambient pressure P1, fuel injection quantity Q, etc. The electronic control device 60 can also be supplied with signals for various other factors related to the operation of the engine that are detected by conventional sensors.

Oil leaked from the sliding parts in the casing 20 and oil in the space surrounded by the driven flange 31 and the slide contact plate 47 are allowed to escape into the oil tank 58 through a return passage 61 in the casing 20, an escape port 62, and an escape passage 63 connected to the escape port 62.

In operation, the rotation of the engine is transmitted to the driving gear 11 through the crankshaft and then to the driven gear 10. The gear 10 drives the flanges 24, and then flange 31 by means of the pins 38 and the larger and smaller eccentric cams 37 and 34 of the dual eccentric cam mechanism. Thus, the hub 30 rotates the cam shaft 7. As the cam shaft 7 rotates, a plunger (not shown) of the fuel injection pump is operated to inject fuel.

If the driven flange 31 needs to be advanced in phase angle in this state, the electronic control device 60 operates in accordance with the input signals from the sensors and sends the signals to the valve 56. Then, the valve 56 is operated to increase the oil pressure in the pressure chamber 51, so that the piston 52 is moved toward the right of FIG. 2. As the piston 52 moves in this way, the pair of sliders 40 are moved radially outward. The radially outward movement of the sliders 40 causes the large eccentric cams 34 to rock in the direction of arrow A of FIG. 3 by the eccentric pins 39. The rocking of the larger eccentric cams 34 causes the smaller eccentric cams 37 to rock in the direction of arrow B, so that the pins 38 are moved in the direction of arrow C or the circumferential direction of the casing 20, and the driven flange 31 is advanced relatively to the driving flange 31.

As a result, the cam shaft 7 is rotated with respect to the engine shaft in the advancing direction through a required angle. Thus, the injection timing for the fuel injected from the fuel injection pump is advanced.

If the driven flange 31 needs to be delayed in phase angle, an operation reverse to the phase-angle advancing operation is performend.

Thus, when the pressure control valve 56 is controlled by means of the electronic control device 60 to adjust the oil pressure in the pressure chamber 51, the rotation phase difference of the fuel injection timing can be regulated freely.

In the embodiment described above, the pump housing 4 is attached to the cylinder block 1 on the engine side by means of the casing 20 of the timer unit 23 itself. It is therefore unnecessary to use the gear case 2 as shown in FIG. 1, so that the number of parts used in the device, as well as the outer diameter and axial dimension L of the device, can be reduced. Accordingly, the pump housing 4 can be mounted even if the space between the pump housing 4 and the cylinder block 1 is narrow.

For proper engagement between the driven gear 10 and the driving gear 11, the pump housing 4 is first removed from its mounting section (not shown), and the bolt 21 is loosened. Since the ball bearing 26 between the casing 20 and the driving flange 24 supporting the driven gear 10 is located close to the driven gear 10 in the structure of FIG. 2, the engagement between the driven gear 10 and the driving gear 11 will hardly be influenced by lateral movement of the cam shaft 7. Accordingly, the bolts 21 are first tightened, and then the pump housing 4 is fixed to the mounting section. In the prior art device shown in FIG. 1, on the other hand, the ball bearing 12 supporting the cam shaft 7 on the gear case 2 is considerably separated from the driven gear 10, so that the degree of engagement between the driven gear 10 and the driving gear 11 will vary if the pump housing 4 is fixed to its mounting section after previously tightening the bolts 3. Therefore, the engagement between the gears 10 and 11 must be adjusted after fixing the pump housing 4 to its mounting section. Thus, the device of the invention has an advantage over the prior art device, and is less liable to hysteresis in timer characteristic.

The casing 20 can be adjusted along the arcuate fitting hole 22, so that errors in machining and assembly can readily be absorbed, and the injection timing can be set also by rockably adjusting the casing 20.

Figure 5:
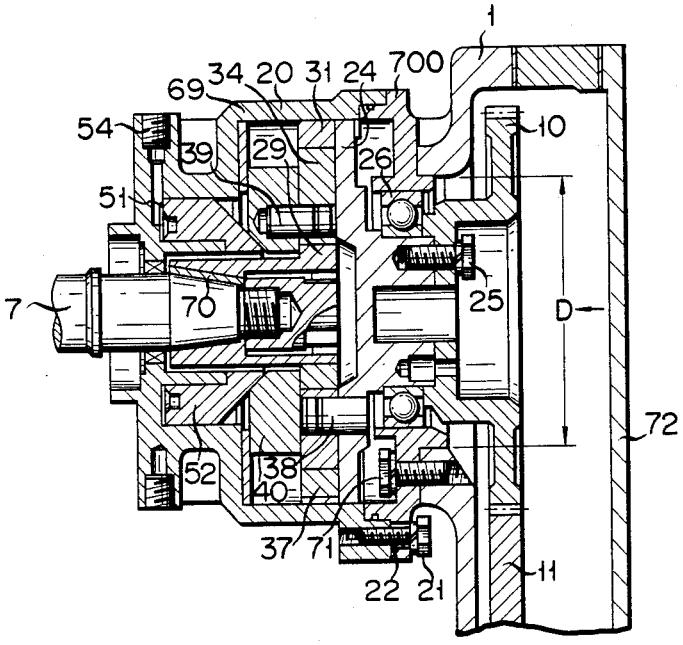
FIG. 5 is a vertical sectional view of a fuel injection timing device according to another embodiment of the invention.

This invention is not limited to the aforementioned embodiment shown in FIGS. 2 to 4. FIG. 5 shows another embodiment, in which the casing 20 is formed of a main body section 69 surrounding the timer unit 23 and the driven section 29, and a coupling member 700 retaining the ball bearing 26. This embodiment is adapted to the case where the area (D) of the opening portion 1*a* of the cylinder block 1 is small. In general, the manufacturing cost may be reduced by using a small ball bearing. In this case, however, the ball bearing fitting hole of the casing 20 is so small that the timer unit 23 cannot be put into the casing 20 through the fitting hole. Thereupon, the use of the coupling member 700 facilitates the setting of the timer unit 23 in the casing 20. Namely, after the driven gear 10 is removed, the coupling member 70 is fixed to the cylinder block 1 by means of blots 71, and the casing 20 containing the timer unit 23 is fixed to the coupling member 70 by means of the arcuate fitting hole 22 and the bolt 21. The driven gear 10 is coupled to the driving flange 24 by means of the bolts 25 with a cover 72 removed from the cylinder block 1. Thereafter, the cover 72 is attached to the cylinder block 1.

The timer unit 23 of this invention is not limited to the one which uses the hydraulically operated piston 52 and the dual eccentric cam mechanism, and may also be of, e.g., the conventional centrifugal weight type.

What we claim is:

1. A fuel injection timing device for an internal combustion engine, comprising:

a cam shaft connected to a fuel injection pump;

a driven section coupled to the cam shaft and having a driven flange;

a driving flange adjacent to the driven flange and coaxial with the cam shaft;

a driven gear fixed to the driving flange so as to be coaxial with the cam shaft and in mesh with a driving gear driven by the internal combustion engine in a cylinder block facing the fuel injuection pump;

cam shaft phase angle changing means mounted on the driving flange for advancing and delaying the cam shaft in phase angle in cooperation with the driving flange and the driven flange; and a casing containing and carrying the driven section, the driving flange, and the cam shaft phase angle changing means and having two ends, one of which is supported by the fuel injection pump and the other of which supports the driving flange and is supported by the cylinder block; wherein said cam shaft phase angle changing means includes slider means movable by a piston reciprocable in said casing in the radial directions of the driven flange, and eccentric cam means for advancing and delaying, in cooperation with the slider means, the driven flange and the driving flange, and cam shaft in phase angle in accordance with the position of the slider means relative to the driven flange.

2. The device according to claim 1, wherein said driving flange is supported by said other end of the casing by a bearing.

3. The device according to claim 2, wherein said bearing is a ball bearing.

4. A fuel injection timing device for an internal combustion engine, comprising:

a cam shaft connected to a fuel injection pump;

a driven section coupled to the cam shaft and having a driven flange;

a driving flange adjacent to the driven flange and coaxial with the cam shaft;

a driven gear fixed to the driving flange so as to be coaxial with the cam shaft and in mesh with a driving gear driven by the internal combustion engine in a cylinder block facing the fuel injuection pump;

cam shaft phase angle changing means mounted on the driving flange for advancing and delaying the cam shaft in phase angle in cooperation with the driving flange and the driven flange; and a casing containing and carrying the driven section, the driving flange, and the cam shaft phase angle changing means and having two ends, one of which is supported by the fuel injection pump and the other of which supports the driving flange and is supported by the cylinder block; wherein said casing contains a reciprocable piston and comprising a main body section containing the driven section and the cam shaft phase angle changing means operated by the piston, and a hollow coupling member adjustably connected to the main body section to retain the bearing.

5. A fuel injection timing device for an internal combustion engine, comprising:

a cam shaft connected to a fuel injection pump;

a driven section coupled to the cam shaft and having a driven flange;

a driving flange adjacent to the driven flange and coaxial with the cam shaft;

a driven gear fixed to the driving flange so as to be coaxial with the cam shaft and in mesh with a driving gear driven by the internal combustion engine in a cylinder block facing the fuel injection pump;

cam shaft phase angle changing means for advancing and delaying the cam shaft in phase angle in cooperation with the driving flange and the driven flange, said cam shaft phase angle changing means comprising slider means movable in the radial directions of the driven flange, eccentric cam means for advancing and delaying, in cooperation with the slider means, the driven flange and the driving flange, the cam shaft in phase angle in accordance with te position of the slider means relative to the drive flange, and a piston surrounding the cam shaft so as to be movable along the cam shaft, receiving pressurized oil at one end, and having at the other end a truncated conical surface increasing the diameter toward said one end, said slider means including a pair of sliders arranged symmetrically with respect to the cam shaft and having a truncated conical surface complemetary to and engaging the truncated conical surface of the piston, and a pair of parallel guide shafts penetrating the sliders to guide the guide shafts.

6. The device according to claim 5, wherein springs for urging the sliders toward the cam shaft are disposed between ends of the guide shafts and the sliders and surround the respective guide shafts.

7. The device according to claim 6, wherein said eccentric cam means comprises a pair of first pins inserted into the sliders between the guide shafts and extending parallel to the cam shaft, a pair of first eccentric cams penetrated by their corresponding first pins at positions off centers thereof so as to be rockable in the driven flange, a pair of second pins passed through the driving flange and the corresponding first eccentric cams so as to extend parallel to the first pins, and a pair of second eccentric cams penetrated by the corresponding second pins at positions off centers thereof so as to be rockable in the first eccentric cams, each pair of the first pins and the second pins, and the first eccentric cams and the second eccentric cams being arranged symmetrically with respect to the cam shaft.

8. The device according to claim 5, wherein said casing contains a reciprocable piston and comprises a main body section containing the driven section and the cam shaft phase angle changing means operated by the piston, and a hollow coupling member adjustably connected to the main body section to retain the bearing.

9. The device according to claim 5, wherein said driving flange is supported by said other end of the casing by a bearing.

10. The device according to claim 9, wherein said bearing is a ball bearing.

11. The device according to claim 5, which comprises a piston reciprocably in the casing and wherein said cam shaft phase angle changing means includes slider means moved by the piston in the radial directions of the driven flange, and eccentric cam means for advancing the delaying, in cooperation with the slider means, the driven flange and the driving flange, the cam shaft in phase angle in accordance with the position of the slider means relative to the driven flange.

* * * * *